US008287111B2

(12) United States Patent
Kanbe et al.

(10) Patent No.: US 8,287,111 B2
(45) Date of Patent: Oct. 16, 2012

(54) LIQUID CONTAINERS

(75) Inventors: Tomohiro Kanbe, Nagoya (JP); Hisaki Sakurai, Aichi-ken (JP); Toyonori Sasaki, Anjo (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 356 days.

(21) Appl. No.: 12/722,456

(22) Filed: Mar. 11, 2010

(65) Prior Publication Data

US 2010/0245501 A1 Sep. 30, 2010

(30) Foreign Application Priority Data

Mar. 31, 2009 (JP) ..... 2009-084301

(51) Int. Cl.
*B41J 2/175* (2006.01)
*B41J 2/195* (2006.01)

(52) U.S. Cl. ..... 347/86; 347/7

(58) Field of Classification Search ..... 347/7, 85, 347/86, 87

See application file for complete search history.

(56) References Cited

U.S. PATENT DOCUMENTS

| | | | | |
|---|---|---|---|---|
| 7,178,911 | B2 * | 2/2007 | Katayama et al. | 347/86 |
| 7,357,494 | B2 * | 4/2008 | Katayama et al. | 347/86 |
| 7,566,120 | B2 * | 7/2009 | Ishizawa et al. | 347/86 |
| 8,038,275 | B2 * | 10/2011 | Hattori | 347/86 |
| 2005/0068389 | A1 | 3/2005 | Katayama et al. | |
| 2008/0239033 | A1 | 10/2008 | Hattori | |

FOREIGN PATENT DOCUMENTS

| | | | |
|---|---|---|---|
| JP | S63-147650 | A | 6/1988 |
| JP | H07-314716 | A | 12/1995 |
| JP | H08-281966 | A | 10/1996 |
| JP | 2005-125738 | A | 5/2005 |
| JP | 2008-254194 | A | 10/2008 |

* cited by examiner

*Primary Examiner* — Anh T. N. Vo
(74) *Attorney, Agent, or Firm* — Baker Botts L.L.P.

(57) ABSTRACT

A liquid container includes a liquid chamber configured to store liquid, and a float positioned in the liquid chamber and configured to move according to a change in a level of a liquid surface in the liquid chamber. The float includes a liquid-retaining portion configured to retain liquid therein, and at least a portion of the liquid-retaining portion is positioned above the liquid surface when a portion of the float is positioned above the liquid surface.

15 Claims, 12 Drawing Sheets

LIQUID CONTAINERS

CROSS REFERENCE TO RELATED APPLICATION

The present application claims priority to and the benefit of Japanese Patent Application No. 2009-084301, which was filed on Mar. 31, 2009, the disclosure of which is incorporated herein by reference in its entirety.

BACKGROUND OF THE INVENTION

1. Field of the Invention

The present invention relates to liquid containers comprising a float in a liquid chamber.

2. Description of Relate Art

A known liquid container is configured to store liquid therein and to be removably mounted to a liquid-consuming apparatus. When the liquid container is mounted to the liquid-consuming apparatus, liquid stored in the liquid container is consumed by the liquid-consuming apparatus. Another liquid container is positioned in and unremovably fixed to a known liquid-consuming apparatus. In such known liquid containers, the presence/absence of liquid or the remaining amount of liquid stored in the liquid container is regarded as necessary information for a user in using the liquid-consuming apparatus. Examples of such a liquid container include an ink cartridge to be mounted to a printer when the printer is used, and an ink tank positioned in and unremovably fixed to a printer. As methods of determining the presence/absence of ink or the remaining amount of ink stored in the ink cartridge or the ink tank, a known method has been provided, in which the change in the level of ink surface is detected with a float positioned in the ink cartridge or the ink tank. For example, a known ink cartridge such as an ink cartridge described in JP-A-2008-254194, has a float supported by an arm. When a sufficient amount of ink remains in this ink cartridge, the float tends to float on the liquid surface with its buoyancy. However, because the movement of the arm is regulated, the float is submerged in the ink. When the remaining amount of ink becomes small and the liquid surface descends, a portion of the float is exposed above the liquid surface. Subsequently, following the descending liquid surface, the float moves down. A known ink tank such as an ink tank described in JP-A-63-147650 has a float always floating on the liquid surface and moves down following the descending of the liquid surface.

Bubbles or films of liquid may be generated in the above-described liquid containers. Such bubbles or films of liquid may adhere to and push up the float, or the surface tension of bubbles or films of liquid contacting the float and a wall of the liquid container may hinder the movement of the float. For these and other reasons, there has been a problem that the float may not follow the movement of the liquid surface descending along with the consumption of ink.

To solve this problem, the mass or weight of the float is increased, whereby a gravity equivalent to the increased mass or weight is added to the float. The additional gravity enables the float to break the bubbles or the films of liquid adhering to the float, such that the float can move following the descending liquid surface.

Before the ink cartridge described in JP-A-2008-254194 is used, that is, when there is a sufficient amount of ink remaining in the ink cartridge, the float is in the highest position within the movable range of the float within the ink. It is the buoyancy acting on the float that pushes up the float to the highest position. Therefore, when the mass or weight of the float is simply increased as described above, which means that the force (gravity) that moves down the float increases, the force that pushes up the float, i.e., the resultant force of the buoyancy and the gravity, is reduced.

Bubbles or films of ink may be already generated in the ink cartridge before the ink cartridge is used because of, for example, vibrations occurring during the transportation of the ink cartridge. In such a case, if the force that pushes up the float is reduced with the increase of the mass or weight of the float as described above, the force that pushes up the float cannot overcome the hindering force of the bubbles or films of ink, such that the float cannot move up to the highest position. Consequently, it may be determined that the remaining amount of ink is small, despite that the cartridge is not used.

Similarly, if the mass or weight of the float is increased in the ink tank described in JP-A-63-147650, the float may not be able to move up to the highest position because of the hindering of bubbles or the films of ink, despite that the ink tank is full of ink. Consequently, it may be determined that the remaining amount of ink is less than the full amount.

SUMMARY OF THE INVENTION

Therefore, a need has arisen for liquid containers which overcome these and other shortcomings of the related art. A technical advantage of the present invention is that upward movement and downward movement of a float is smoothened even if bubbles or films of liquid are generated in a liquid container.

According to an embodiment of the present invention, a liquid container comprises a liquid chamber configured to store liquid, and a float positioned in the liquid chamber and configured to move according to a change in a level of a liquid surface in the liquid chamber. The float comprises a liquid-retaining portion configured to retain liquid therein, and at least a portion of the liquid-retaining portion is positioned above the liquid surface when a portion of the float is positioned above the liquid surface.

Other objects, features, and advantages will be apparent to persons of ordinary skill in the art from the following detailed description of the invention and the accompanying drawings.

BRIEF DESCRIPTION OF THE DRAWINGS

For a more complete understanding of the present invention, needs satisfied thereby, and the objects, features, and advantages thereof, reference now is made to the following description taken in connection with the accompanying drawing.

DETAILED DESCRIPTION OF EMBODIMENTS OF THE INVENTION

Embodiments of the present invention, and their features and advantages, may be understood by referring to FIGS. 1-12B, like numerals being used for like corresponding parts in the various drawings.

A first embodiment of the present invention will now be described. In this embodiment, the present invention is applied to an ink cartridge 5 (liquid container) configured to be removably mounted to an inkjet printer 1 (hereinafter, printer 1) configured to record an image or the like on a recording medium, e.g., a sheet of paper, by ejecting ink toward the recording medium.

Figure 1:
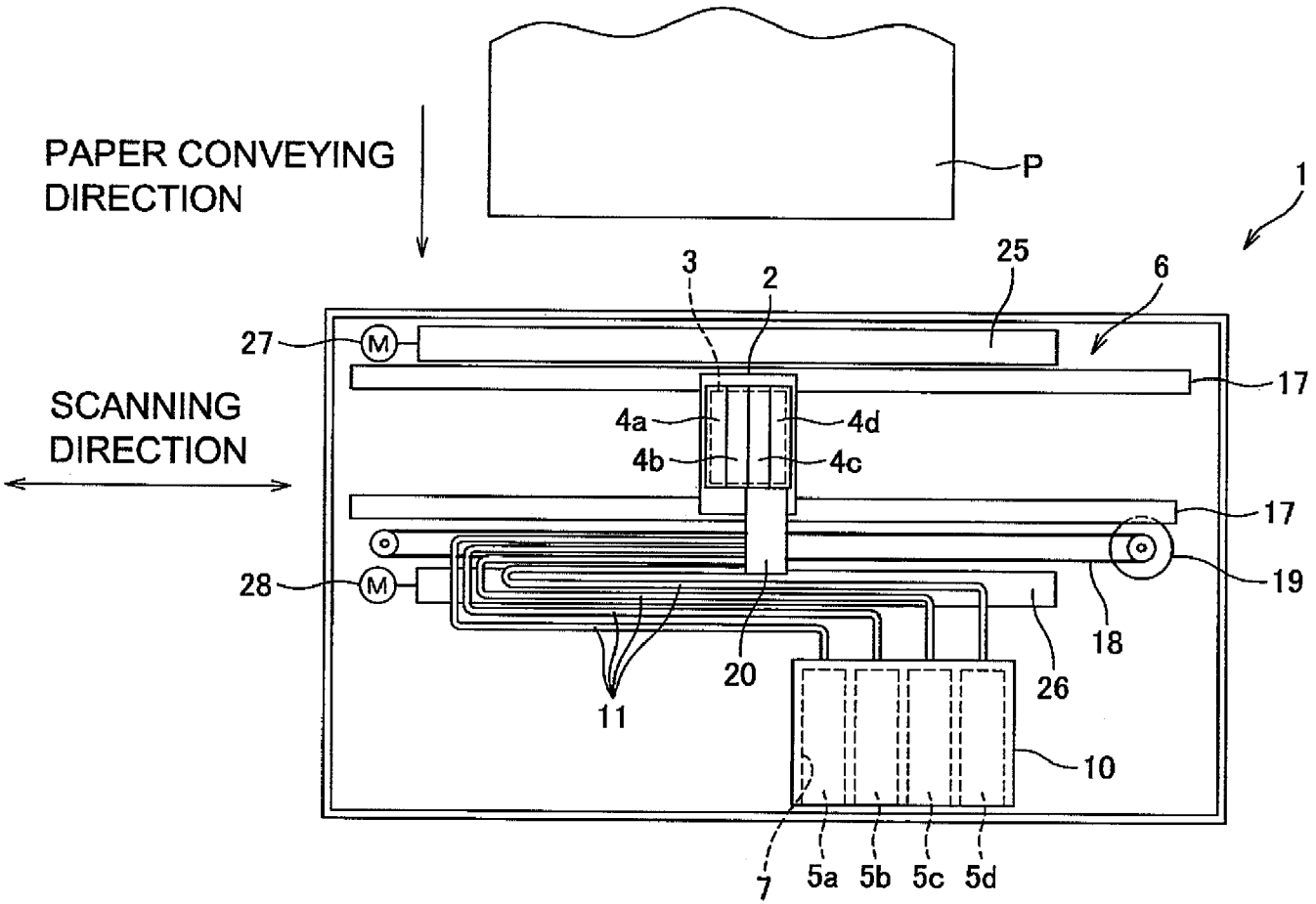
FIG. 1 is a plan view of a printer to which an ink cartridge according to a first embodiment is to be mounted.

Referring to FIG. 1, the printer 1 comprises a carriage 2 configured to reciprocate in a scanning direction shown in FIG. 1, an inkjet head 3 and sub-tanks 4*a* to 4*d* mounted on the carriage 2, the holder 10 to which four ink cartridges 5*a* to 5*d* are to be mounted, and a conveyance mechanism 6 configured to convey a sheet of paper P in a paper conveying direction shown in FIG. 1.

The carriage 2 is configured to reciprocate along two guide shafts 17 extending parallel to each other in the lateral direction (scanning direction) in FIG. 1. An endless belt 18 is connected to the carriage 2. When the endless belt 18 is driven to run by a carriage drive motor 19, the carriage 2 moves in the scanning direction with the running of the endless belt 18.

The inkjet head 3 has in the bottom face thereof (the face hidden behind in FIG. 1) a number of ink ejection nozzles. The four sub-tanks 4*a* to 4*d* are arranged side by side in the scanning direction. A tube joint 20 is integrally provided on the four sub-tanks 4*a* to 4*d*. The four sub-tanks 4*a* to 4*d* are in fluid communication with the holder 10 through flexible tubes 11 connected to the tube joint 20.

The holder 10 comprises four cartridge mounting portions 7 (container mounting portions) arranged in one direction (the scanning direction in FIG. 1). The four ink cartridges 5*a* to 5*d* are configured to be mounted to the four cartridge mounting portions 7, respectively. The four ink cartridges 5*a* to 5*d* store inks of four colors: black, yellow, cyan, and magenta, respectively. Details of the cartridge mounting portions 7 will be described separately below.

The inks of the four colors respectively stored in the four ink cartridges 5*a* to 5*d* are supplied to the four sub-tanks 4*a* to 4*d* through the four tubes 11 connected to the holder 10, are temporarily stored in the sub-tanks 4*a* to 4*d*, and are subsequently supplied to the inkjet head 3. While the inkjet head 3 reciprocates in the scanning direction together with the carriage 2, the inkjet head 3 ejects ink droplets from a number of the ink ejection nozzles provided in the bottom face thereof onto the sheet of paper P conveyed in the downward direction (paper conveying direction) in FIG. 1 by the conveyance mechanism 6. An ink supply system (liquid supply device) of the printer 1 comprises the holder 10, having the four cartridge mounting portions 7, and the four tubes 11.

The conveyance mechanism 6 comprises a paper feed roller 25 provided on the upstream side in the paper conveying direction with respect to the inkjet head 3, and a paper discharge roller 26 provided on the downstream side in the paper feed direction with respect to the inkjet head 3. The paper feed roller 25 and the paper discharge roller 26 are driven to rotate by a paper feed motor 27 and a paper discharge motor 28, respectively. The conveyance mechanism 6 is configured to feed the sheet of paper P to the inkjet head 3 from the upper side in FIG. 1 by using the paper feed roller 25, and to discharge the sheet of paper P having an image, characters, or the like recorded thereon by the inkjet head 3 toward the lower side in FIG. 1 by using the paper discharge roller 26.

Figure 2:
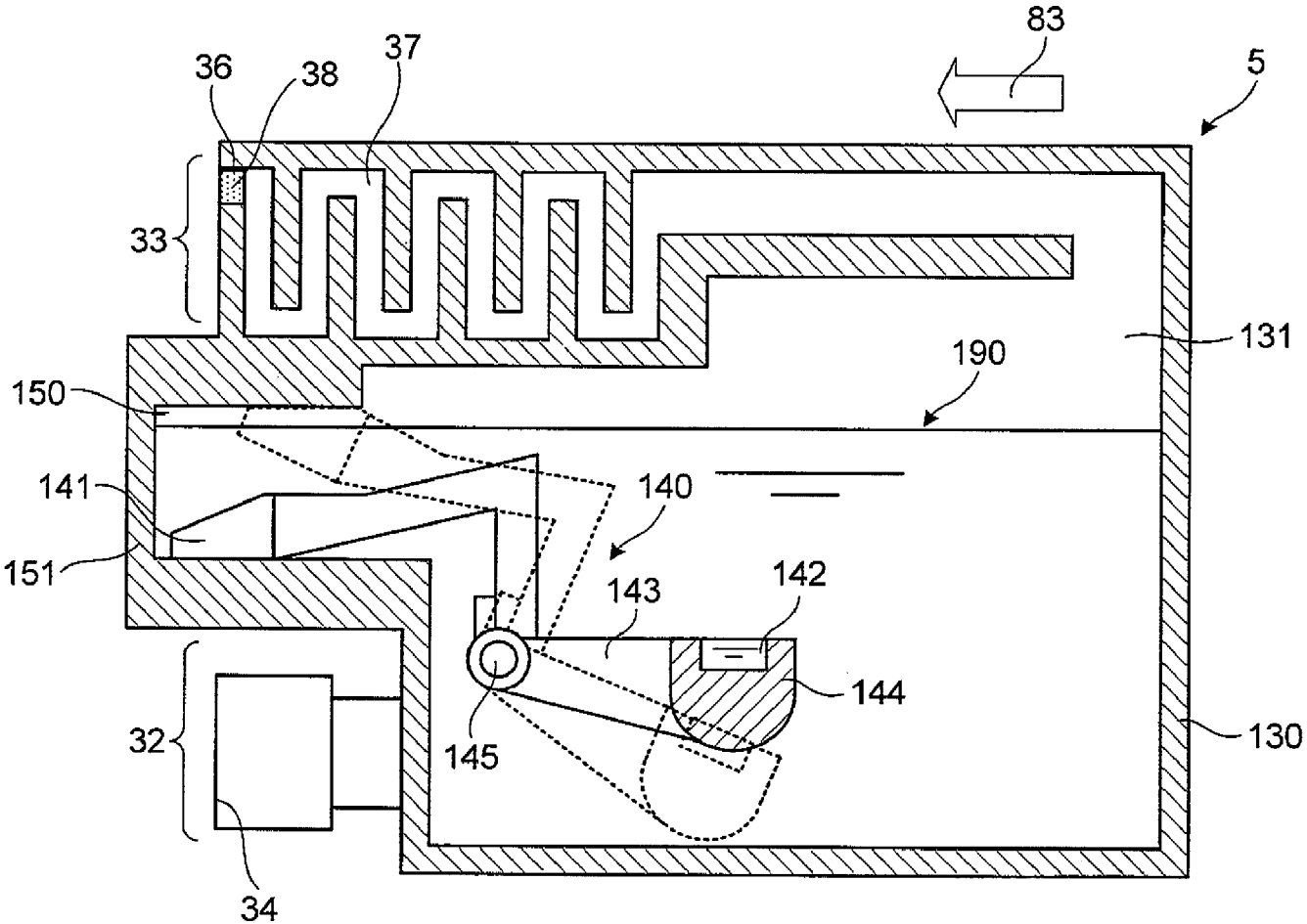
FIG. 2 is a cross-sectional view of an ink cartridge according to a first embodiment.

Next, referring to FIGS. 2-3B, the ink cartridges 5*a* to 5*d* (liquid containers) configured to be mounted to the cartridge mounting portions 7 will be described. Because the four ink cartridges 5*a* to 5*d* respectively containing inks of the four colors have identical configurations, the following description will be provided focusing on one of them (hereinafter, ink cartridge 5). In FIG. 2, an ink supply portion 32 is shown in a side view, not in a cross-sectional view. A direction in which the ink cartridge 5 is moved during mounting of the ink cartridge 5 to the cartridge mounting portion 7 is defined as a mounting direction 83.

Referring to FIG. 2, the ink cartridge 5 (liquid container) comprises an ink chamber 131 (liquid chamber) configured to store ink therein, a pivotable member 140 positioned in the ink chamber 131, the ink supply portion 32 configured to supply ink stored in the ink chamber 131 to the ink supply system of the printer 1, and an air introduction portion 33 configured to introduce air from the exterior of the ink cartridge 5 into the ink chamber 131.

Referring to FIG. 2, the ink cartridge 5 comprises a casing 130 that has a substantially rectangular-parallelpiped shape and is made of a synthetic resin material such as polyacetal, nylon, polyethylene, or polypropylene, through which light can pass. The casing 130 comprises the ink chamber 131 formed therein. Furthermore, the casing 130 comprises a projecting portion 151 projecting in the mounting direction 83. The projecting portion 151 comprises a detection chamber 150 formed therein, and the detection chamber 150 is in fluid communication with the ink chamber 131. A light-blocking plate 141 (to-be-detected portion) of the pivotable member 140, which will be described below, is positioned in the detection chamber 150 of the projecting portion 151.

Among the outer faces of the casing 130, the face facing forward in the mounting direction 83 during the mounting of the ink cartridge 5 to the cartridge mounting portion 7 (the face on the left side in FIG. 2) is referred to as the front face, and the face facing rearward during the mounting of the ink cartridge 5 to the cartridge mounting portion 7 (the face on the right side in FIG. 2) is referred to as the rear face. Moreover, among the outer surfaces of the casing 130, in a state where the ink cartridge 5 is on the cartridge mounting portion 7, the face at the top end (the face on the upper side in FIG. 2) is referred as the top face, and the face at the bottom end (the face on the lower side in FIG. 2) is referred to as the bottom face.

Referring to FIG. 2, the pivotable member 140 is positioned in the ink chamber 131 and is pivotably supported by a shaft 145 extending in a direction perpendicular to the cross-section shown in FIG. 2. Referring to FIGS. 2-3B, the pivotable member 140 comprises an arm 143 configured to pivot about the shaft 145, a float 144 positioned at a first end of the arm 143 and configured to move according to the change in the level of an ink surface 190 in the ink chamber 131, and the light-blocking plate 141 positioned at a second end of the arm 143 and configured to move according to the movement of the float 144 via the arm 143.

The pivotable member 140 is made of a material, such as a synthetic resin material, having a specific gravity which is less than the specific gravity of ink stored in the ink chamber 131. In another embodiment, at least the specific gravity of the float 144 may be less than the specific gravity of ink. Moreover, the material and structure of the pivotable member 140 may be arbitrary, as long as the float 144 can float up toward the ink surface 190. For example, the pivotable member 140 may be made of a foamed material. Alternatively, the pivotable member 140 may be made of a material such as a synthetic resin material, with the float 144 having a closed inner space formed therein.

Because the specific gravity of the float 144 is less than the specific gravity of ink, in a state where the float 144 is submerged in the ink, the float 144 tends to float up toward the ink surface 190 with its buoyancy. In contrast, when a portion of the float 144 is positioned above the ink surface 190, that is, when the float 144 is exposed above the ink surface 190, the buoyancy and gravity acting on the float 144 balance each other out, whereby the float 144 floats on the ink surface 190. If the ink surface 190 descends in the foregoing state, the float 144 moves down, following the descending ink surface 190.

The light-blocking plate 141 is positioned in the detection chamber 150 of the projecting portion 151, and is configured to block light of an optical sensor 186 (see FIG. 4) provided on the cartridge mounting portion 7, which will be described below, when the ink cartridge 5 is mounted to the cartridge mounting portion 7.

Figure 3A:
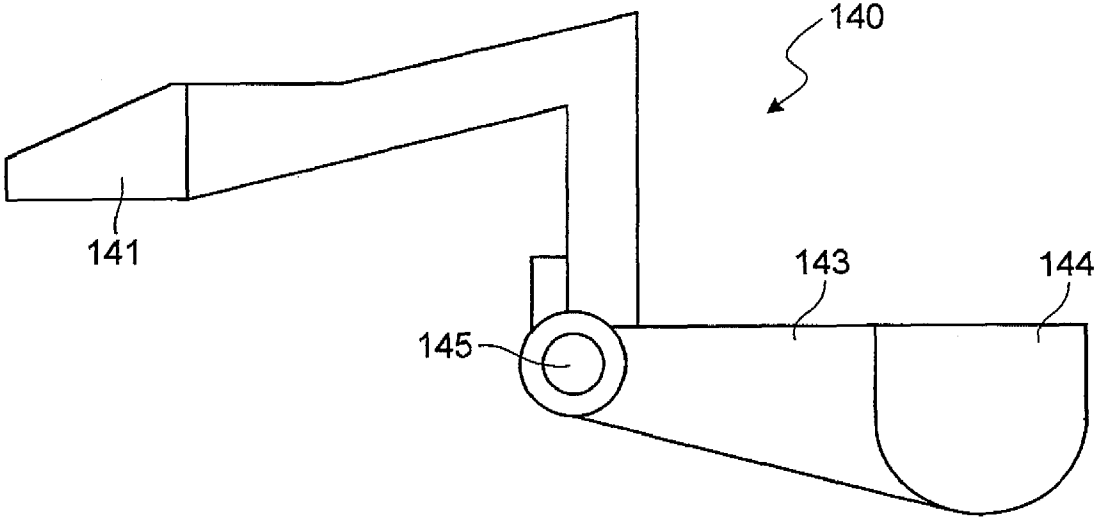
FIG. 3A is a side view of a pivotable member of the ink cartridge of FIG. 2.
Figure 3B:
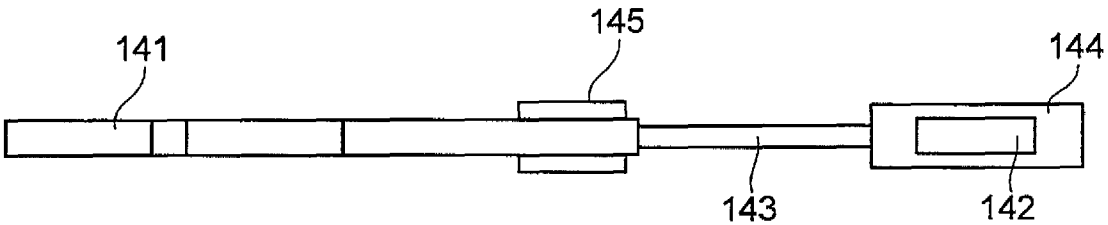
FIG. 3B is a top view of the pivotable member.

Referring to FIGS. 2-3B, the float 144 comprises an ink-retaining portion 142 (liquid-retaining portion) configured to retain ink therein. Referring to FIG. 2, the ink-retaining portion 142 is a hollow formed in an upper portion of the float 144, and the hollow has an open end which is open to the exterior of the float 144 at the top of the float 144. More specifically, the ink-retaining portion 142 has a rectangular shape that is open to the exterior of the float 144 at the top of the float 144 in a cross-sectional view taken in the vertical direction. In addition, the ink-retaining portion 142 is configured such that at least a portion of the ink-retaining portion 142 is positioned above the ink surface 190 when a portion of the float 144 is positioned above the ink surface 190, that is, when the float 144 is exposed above the ink surface 190. With such a configuration, in a state where the float 144 is exposed above the ink surface 190, the ink-retaining portion 142 can retain some ink therein. Thus, in addition to the gravity equivalent to the mass or weight of the float 144 itself, a gravity equivalent to the mass or weight of the ink retained in the ink-retaining portion 142 acts on the float 144, whereby the force that moves down the float 144 can be increased. In contrast, in the state where the float 144 is submerged in the ink, the float 144 is only subjected to the gravity equivalent to the mass or weight of the float 144 itself, and the force that moves up the float 144 toward the ink surface 190 can be maintained without being reduced.

The pivotable member 140 is configured such that, when the float 144 moves up and down with the change in the level of the ink surface 190 in the ink chamber 131, the light-blocking plate 141 connected to the float 144 via the arm 143 moves up and down in the detection chamber 150 relative to the casing 130.

Figure 4:
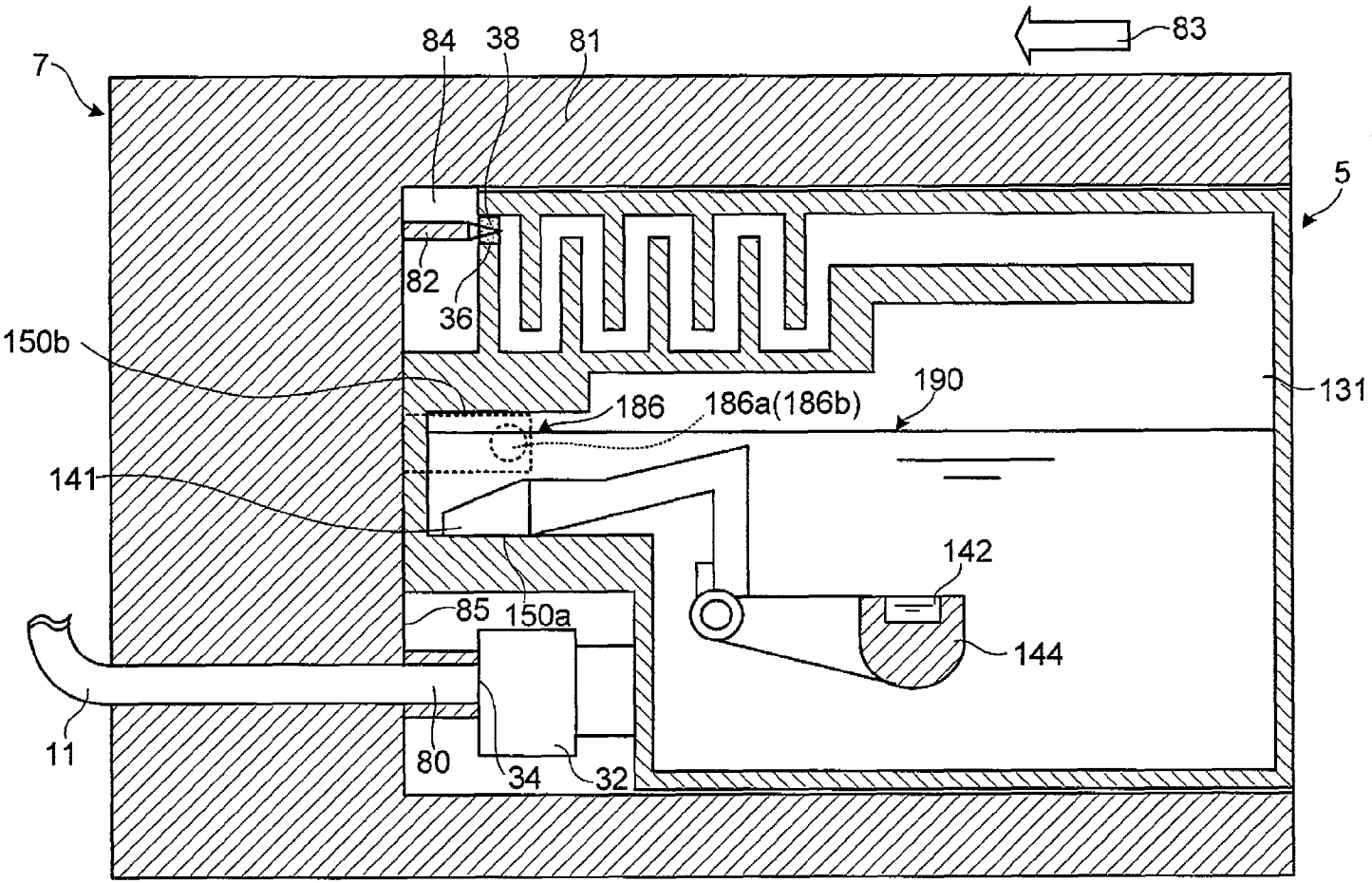
FIG. 4 is a cross-sectional view of the ink cartridge of FIG. 2 and a cartridge mounting portion according to a first embodiment, in which the ink cartridge is mounted to the cartridge mounting portion.

Referring to FIGS. 2 and 4, the ink supply portion 32 is positioned at a lower portion of the front face of the casing 130, i.e., positioned at the front face of the casing 130 adjacent to the bottom face of the casing 130. The ink supply portion 32 has a circular opening 34 formed therein. Moreover, a path (not shown) allowing the opening 34 and the ink chamber 131 to communicate with each other is formed in the ink supply portion 32, and an ink supply valve is positioned in the ink supply portion 32. The ink supply valve is configured to open and close the path allowing the opening 34 and the ink chamber 131 to communicate with each other.

When the ink cartridge 5 is mounted to the cartridge mounting portion 7, an ink supply tube 80 described below (see FIGS. 4 and 6) is inserted into the ink supply portion 32. When the ink supply tube 80 is inserted through the opening 34 into the ink supply portion 32, the ink supply valve opens the path allowing the opening 34 and the ink chamber 131 to communicate with each other. Thus, when the ink cartridge 5 is mounted to the cartridge mounting portion 7, ink stored in the ink chamber 131 can be supplied to the sub-tanks 4*a* to 4*d* through the ink supply tube 80, the tube 11, and the tube joint 20.

Referring to FIG. 2, the casing 130 comprises the air introduction portion 33 in an upper portion thereof. The air introduction portion 33 comprises, in an upper portion of the front face of the casing 130, i.e., at a position of the front face of the casing 130 adjacent to the top face of the casing 130, a circular opening 36 formed through the wall forming the front face of the casing 130. The air introduction portion 33 also comprises, in the casing 130, a labyrinth groove 37, extending from the opening 36 to the ink chamber 131 and having a winding shape. Thus, drying of ink in the ink chamber 131 can be reduced when the air is introduced into the ink chamber 131.

In addition, the opening 36 is covered with a thin film 38 that prevents gas and ink from passing therethrough. Thus, the ink chamber 131 is assuredly kept airtight before the thin film 38 is broken. When a pressing portion 82, which will be described below, is inserted into the opening 36, the pressing portion 82 comes into contact with and breaks the thin film 38 (see FIG. 4). Consequently, the ink chamber 131 and the exterior of the casing 130 communicate with each other through the labyrinth groove 37. Thus, air can be introduced from the exterior of the casing 130 into the ink chamber 131.

Next, referring to FIG. 4, the cartridge mounting portion 7 to which the ink cartridge 5 is to be mounted will be described. Because the cartridge mounting portions 7 to which the four ink cartridges 5*a* to 5*d* are to be mounted have identical configurations, the following description will be provided focusing on one of them.

Referring to FIG. 4, the cartridge mounting portion 7 comprises a frame 81 having a box-like U shape with an open end in a cross-sectional view. An inner space 84 is formed in the frame 81 and serves as a space for receiving the ink cartridge 5. The ink cartridge 5 is inserted into the inner space 84 via the open end of the frame 81 in the mounting direction 83, e.g., a horizontal direction in this embodiment.

Referring to FIG. 4, the frame 81 comprises a wall surface 85 positioned opposite the open end of the frame 81 and facing the inner space 84, and the pressing portion 82 projecting from the wall surface 85 into the inner space 84. The pressing portion 82 is provided at such a position that, when the ink cartridge 5 is on the cartridge mounting portion 7, the pressing portion 82 faces the opening 36 of the ink cartridge 5. Thus, when the ink cartridge 5 is inserted into the cartridge mounting portion 7, the pressing portion 82 comes into contact with the thin film 38, thereby breaking the thin film 38. Consequently, the exterior of the casing 130 and the ink chamber 131 communicate with each other.

The ink supply tube 80 is provided at a lower portion of the wall surface 85, and the ink supply tube 80 is configured to be connected to the ink supply portion 32. The ink supply tube 80 is provided at such a position as to face the opening 34 of the ink supply portion 32 of the ink cartridge 5. The ink supply tube 80 is a resin tube. The ink supply tube 80 is connected to the flexible tube 11 on the back side of the frame 81, as shown in FIG. 4. Thus, when the ink cartridge 5 is mounted to the cartridge mounting portion 7, the ink supply tube 80 is inserted through the opening 34 into the ink supply portion 32. When the ink supply tube 80 is inserted through the opening 34 into the ink supply portion 32, the ink supply valve opens the path allowing the opening 34 and the ink chamber 131 to communicate with each other. Consequently, the ink in the ink chamber 131 can be supplied to the inkjet head 3 through the ink supply portion 32, the ink supply tube 80, the tube 11, the tube joint 20, and the sub-tank 4 (4*a* to 4*d*).

The optical sensor 186 is provided at a middle portion of the wall surface 85 with respect to the height direction of the frame 81 (the vertical direction). The optical sensor 186 comprises a light emitter 186*a* and a light receiver 186*b* facing each other with a space interposed therebetween, such that the projecting portion 151 of the ink cartridge 5 is placed therebetween in the horizontal direction, when the ink cartridge 5 is mounted to the cartridge mounting portion 7. The light emitter 186*a* is configured to emit light such as visible light or infrared light, for example, toward the light receiver 186*b*.

Figure 5:
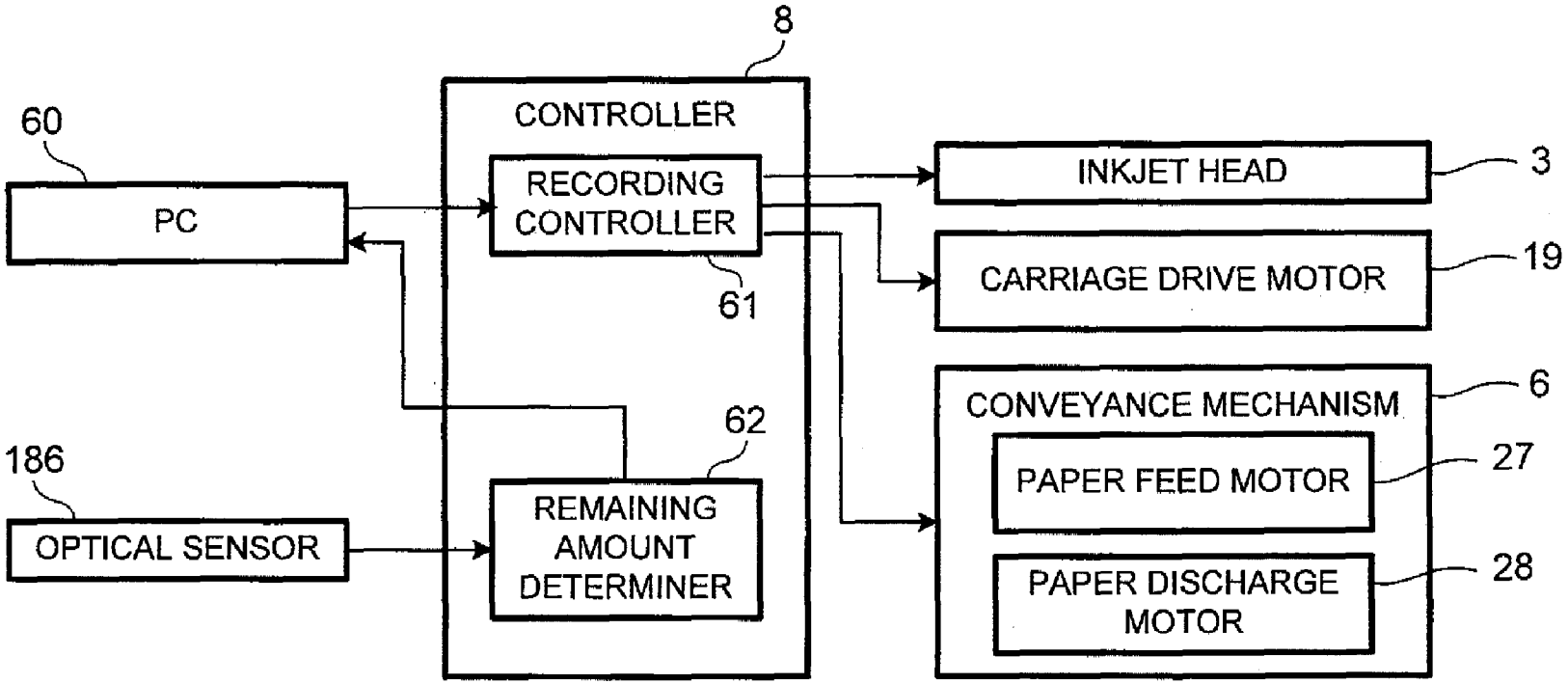
FIG. 5 is a block diagram of an electrical configuration of the printer of FIG. 1.

Next, referring to FIG. 5, the control system of the printer 1 will described. A controller 8 of the printer 1 comprises a CPU (central processing unit), a ROM (read only memory) that stores various programs, data, and the like for controlling the entire operation of the printer 1, a RAM (random access memory) that temporarily stores data and the like processed by the CPU. Programs stored in the ROM are executed by the CPU, whereby the controller 8 performs various control operations described below. In another embodiment, the controller 8 may comprise hardware in which various circuits including an arithmetic circuit are combined together. The controller 8 functions as a recording controller 61 and a remaining-amount-determiner 62.

In accordance with data that is input from a PC 60, the controller 8, as the recording controller 61, controls the inkjet head 3, the carriage drive motor 19, and the paper feed motor 27 and the paper discharge motor 28 of the conveyance mechanism 6, whereby recording of a desired image or the like onto the sheet of paper P is performed.

The controller 8, as the remaining-amount-determiner 62, determines, in accordance with an output signal from the optical sensor 186 provided on the cartridge mounting portion 7, the remaining amount of ink in the ink cartridge 5 mounted to the cartridge mounting portion.

Next, referring to FIGS. 4 and 6, how the remaining amount of ink in the ink cartridge 5 is determined will be described.

The light receiver 186*b* of the optical sensor 186 outputs a signal to the controller 8, as the remaining-amount-determiner 62, in accordance with whether or not the light receiver 186*b* receives the light emitted from the light emitter 186*a* at an intensity greater than or equal to a predetermined intensity. For example, when light having an intensity greater than or equal to the predetermined intensity is received, the light receiver 186*b* outputs a HIGH signal having a high voltage, whereas when light having an intensity less than the predetermined intensity is received (including the case where the intensity is zero), the light receiver 186*b* outputs a LOW signal having a low voltage. If the output from the light receiver 186*b* is the HIGH signal, the controller 8, as the remaining-amount-determiner 62, determines that the remaining amount of ink in the ink cartridge 5 is sufficient. If the output from the light receiver 186*b* is the LOW signal, the controller 8, as the remaining-amount-determiner 62, determines that the remaining amount of ink is small. The controller 8, as the remaining-amount-determiner 62, notifies the PC 60 of either of the results of the determination.

Referring to FIG. 4, when a sufficient amount of ink is stored in the ink chamber 131, a buoyancy greater than the gravity acts on the float 144, and a moment in the counterclockwise direction about the shaft 145 acts on the arm 143. Accordingly, the light-blocking plate 141 is in contact with a bottom surface 150*a* of the detection chamber 150 (see the pivotable member 140 shown in FIG. 4 or shown in broken lines in FIG. 6). In this state, because the entirety of the float 144 is below the ink surface 190, the ink-retaining portion 142 is filled with ink.

In this case, when the ink cartridge 5 is mounted to the cartridge mounting portion 7, the light emitter 186*a* and the light receiver 186*b* of the optical sensor 186 are positioned so as to sandwich the detection chamber 150 adjacent a ceiling surface 150*b* of the detection chamber 150. When a sufficient amount of ink is stored in the ink chamber 131, the light-blocking plate 141 is in contact with the bottom surface 150*a* of the detection chamber 150 and therefore does not block the light emitted from the light emitter 186*a*. Accordingly, the light emitted from the light emitter 186*a* passes through the detection chamber 150 and reaches the light receiver 186*b* at an intensity greater than or equal to the predetermined intensity. Consequently, the controller 8, as the remaining-amount-determiner 62, determines that the remaining amount of ink in the ink cartridge 5 is sufficient and notifies the PC 60 that the remaining amount of ink is sufficient. Here, the degree of light absorption by the ink in the this embodiment is set such that the light emitted from the light emitter 186*a* and passing through the ink in the detection chamber 150 can reach the light receiver 186*b* at an intensity greater than or equal to the predetermined intensity. In this embodiment, whether or not the cartridge 5 is mounted to the cartridge mounting portion 7 is detected by a sensor, e.g., a contact sensor (not shown).

When ink is consumed during an ink-ejecting operation performed by the inkjet head 3 with the ink-retaining portion 142 of the float 144 being filled with ink, the ink surface 190 in the ink chamber 131 of the ink cartridge 5 mounted to the cartridge mounting portion 7 gradually descends.

When the ink surface 190 in the ink chamber 131 further descends, and the remaining amount of ink in the ink chamber 131 becomes small, a portion of the float 144 is exposed above the ink surface 190. This reduces the buoyancy acting on the float 144, whereby the buoyancy and gravity acting on the float 144 balance each other out. In this state, at least a portion of the ink-retaining portion 142 is positioned above the ink surface 190, and some ink is retained in the ink-retaining portion 142. Therefore, a gravity equivalent to the mass or weight of the ink retained in the ink-retaining portion 142 also acts on the float 144. When the ink surface 190 further descends, the float 144 moves down following the descending of the ink surface 190, and the arm 143 pivots clockwise about the shaft 145. The light-blocking plate 141 finally comes into contact with the ceiling surface 150*b* of the detection chamber 150.

Figure 6:
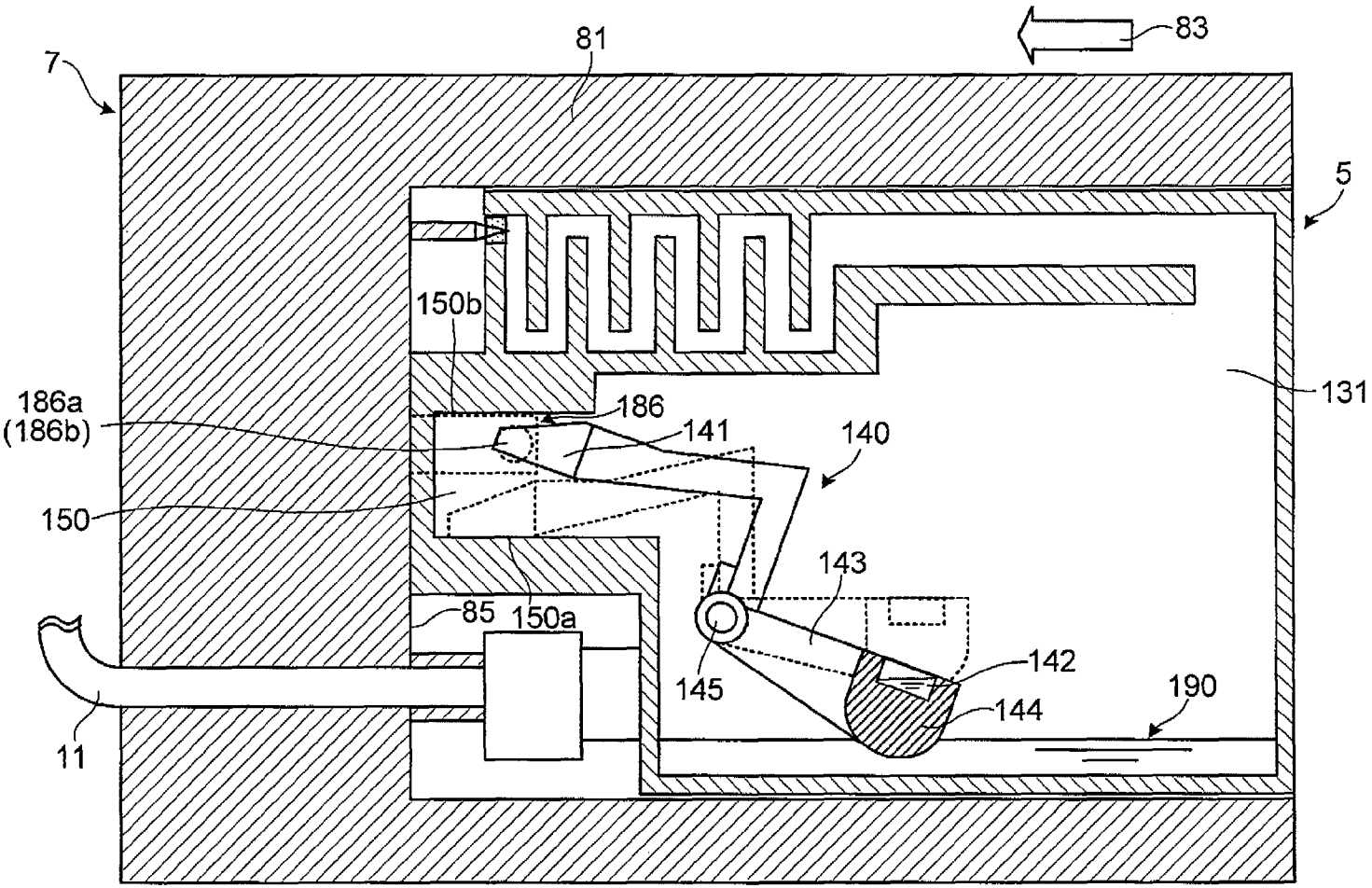
FIG. 6 is a cross-sectional view of the ink cartridge and the cartridge mounting portion of FIG. 4, in which a level of an ink surface is low.

Referring to FIG. 6, when the light-blocking plate 141 contacts the ceiling surface 150*b* of the detection chamber 150, the light-blocking plate 141 is positioned between the light emitter 186*a* and the light receiver 186*b* of the optical sensor 186. When the light-blocking plate 141 is positioned between the light emitter 186*a* and the light receiver 186*b*, the light emitted from the light emitter 186*a* is blocked by the light-blocking plate 141, and the intensity of the light reaching the light receiver 186*b* becomes less than the predetermined intensity (including the case where the intensity is zero). Accordingly, the controller 8, as the remaining-amount-determiner 62, determines that the remaining amount of ink in the ink cartridge 5 has become small, and notifies the PC 60 that the remaining amount of ink is small.

When the amount of ink in the ink chamber 131 becomes small and the float 144 is tilted, some of the ink retained in the ink-retaining portion 142 flows out into the ink chamber 131. Thus, some of the ink that has been retained in the ink-retaining portion 142 can be used for image recording by the inkjet head 3.

In the ink cartridge 5 described above, bubbles and films of ink may be generated in the ink chamber 131. For example, if bubbles contacting the float 144 and the wall of the ink chamber 131 are generated, when a buoyancy acts on the float 144 and the float 144 is supposed to float up, the float 144 may not be able to break the bubbles and therefore may not be able to float up, such that the pivotable member 140 may not be able to pivot counterclockwise. Consequently, the light-blocking plate 141 stays at such a position as to block the light emitted from the light emitter 186*a*, and the controller 8, as the remaining-amount-determiner 62, may therefore determine that the remaining amount of ink is small, despite that there is a sufficient amount of ink in the ink chamber 131. Moreover, if bubbles adhere to the bottom of the float 144 in the state where the float 144 is exposed above the ink surface 190, the bubbles may remain unbroken between the bottom of the float 144 and the wall of the ink chamber 131 when the float 144 is supposed to move down, preventing the pivotable member 140 from pivoting clockwise. Consequently, the light-blocking plate 141 stays at such a position as not to block the light emitted from the light emitter 186*a*, and the controller 8, as the remaining-amount-determiner 62, may therefore determine that the remaining amount of ink is sufficient, despite that the remaining amount of ink in the ink chamber 131 is small. Moreover, if bubbles or films of ink contacting the arm 143 and the wall of the ink chamber 131 are generated, the arm 143 may not be able to break the bubbles or films of ink, such that the pivotable member 140 is prevented from pivoting. In addition, if bubbles or films of ink are generated in the detection chamber 150, the movement of the light-blocking plate 141 may be hindered, leading to a similar problem.

With the configuration described above, however, the float 144 of the pivotable member 140 comprises the ink-retaining portion 142 configured to retain ink therein and, at least a portion of the ink-retaining portion 142 is positioned above the ink surface 190 when the float 144 is exposed above the ink surface 190. Therefore, when the float 144 is exposed above the ink surface 190, some ink is retained in the ink-retaining portion 142 of the float 144. In the state where the float 144 is submerged in the ink, because the mass or weight of the float 144 itself is not increased, the float 144 can break bubbles or films of ink and float up with the force acting on the float 144 to move up the float 144 toward the ink surface 190 not being reduced. In contrast, if the float 144 is exposed above the ink surface 190, a gravity equivalent to the mass or weight of the ink retained in the ink-retaining portion 142 is added to the float 144, whereby a downward force that breaks bubbles or films of ink is produced. That is, regardless of whether the float 144 is submerged in the ink or is exposed above the ink surface 190, the pivotable member 140 having the float 144 can move smoothly. Accordingly, the determination of the remaining amount of ink is made correctly.

Moreover, in the ink cartridge 5 described above, because the light-blocking plate 141 configured to move with the movement of the float 144 is provided at the second end of the arm 143 of the pivotable member 140, the remaining amount of ink can be determined by detecting the light-blocking plate 141 with the optical sensor 186 provided on the cartridge mounting portion 7.

Moreover, because the ink-retaining portion 142 has a rectangular shape in the cross-sectional view, the ink-retaining portion 142 can be formed with a relatively simple structure in the float 144.

The ink cartridge 5 is configured to be removably mounted to the cartridge mounting portion 7 of the ink supply system of the printer 1. The float 144 can move smoothly even if bubbles or films of ink are generated in the ink chamber 131 of the ink cartridge 5 when the ink cartridge 5 is mounted to the cartridge mounting portion 7.

Figure 7:
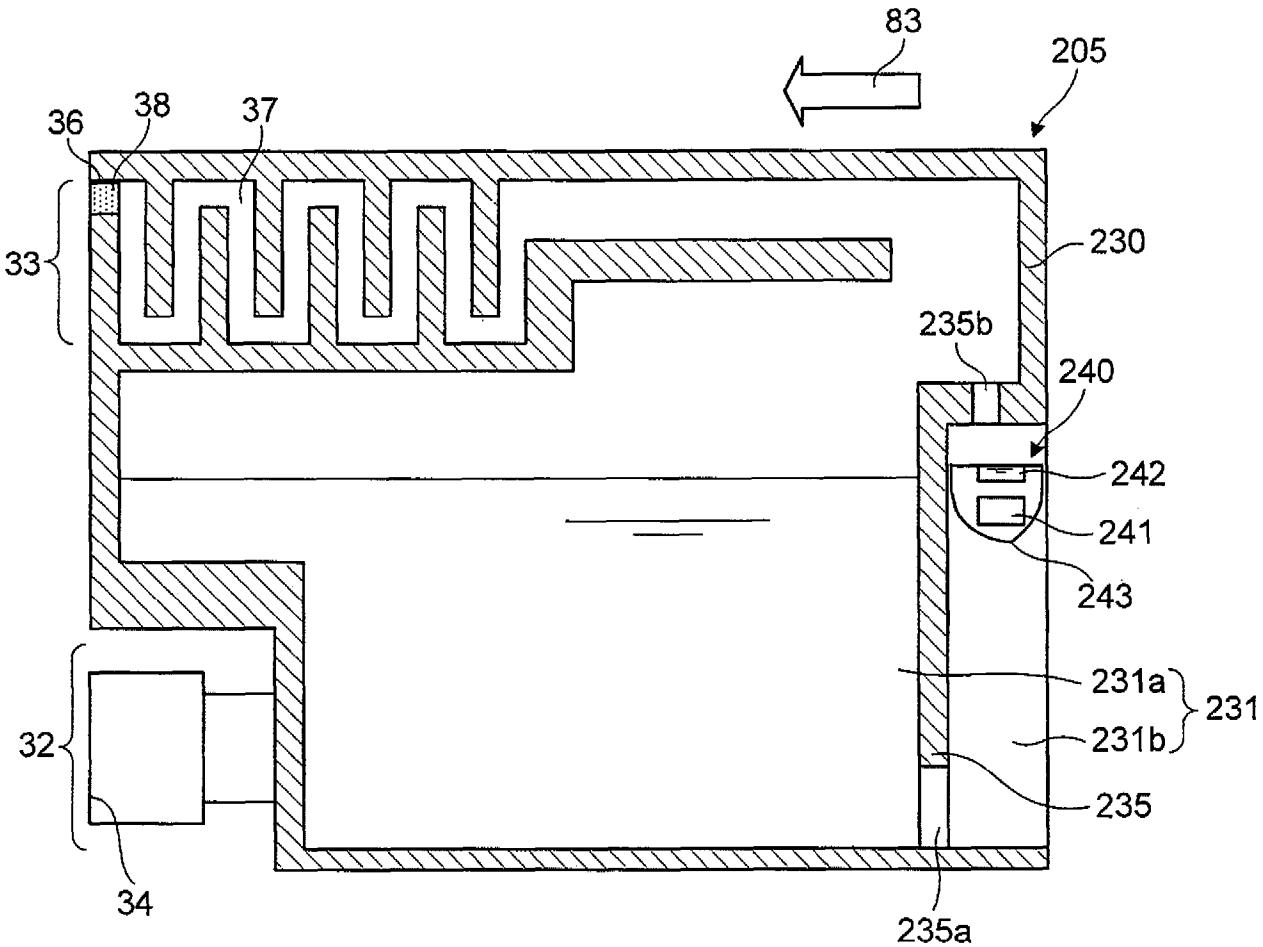
FIG. 7 is a cross-sectional view of an ink cartridge according to a second embodiment.

Next, referring to FIGS. 7-10C, a second embodiment will be described. In FIGS. 7 and 9, the ink supply portion 32 is shown in a side view, not in a cross-sectional view. In addition, elements whose shapes and functions are identical with those in the first embodiment are denoted by the same reference numerals as in the first embodiment, and the description thereof is omitted.

An ink cartridge 205 according to the second embodiment configured to be mounted to the cartridge mounting portion 207 will be described.

Referring to FIG. 7, the ink cartridge 205 (liquid container) comprises an ink chamber 231 (liquid chamber) configured to store ink therein, a float 240 positioned in the ink chamber 231, the ink supply portion 32 configured to supply ink stored in the ink chamber 231 to the ink supply system of the printer 1, and the air introduction portion 33 configured to introduce air into the ink chamber 231. The ink supply portion 32 and the air introduction portion 33 are identical with those in the first embodiment.

Figure 8B:
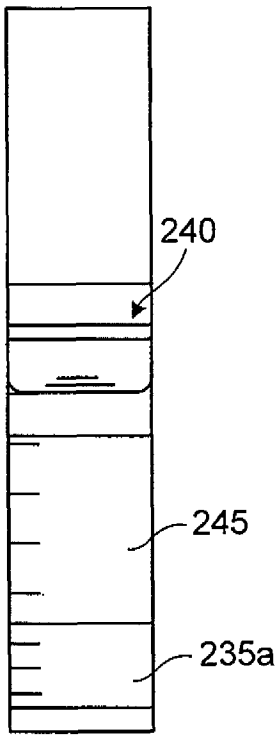
FIG. 8B is a rear view of the ink cartridge of FIG. 7.

Referring to FIGS. 7-8B, the ink cartridge 205 comprises a casing 230 having a substantially rectangular-parallelpiped shape. The casing 230 is made of a synthetic resin material such as polyacetal, nylon, polyethylene, or polypropylene, through which light can pass. Moreover, the casing 230 comprises at the rear face thereof a transparent cover 245 made of a synthetic resin material, through which light can pass. The cover 245 is fitted to the rear face of the casing 230.

The ink chamber 231 comprises a main ink chamber 231*a* and a detection chamber 231*b*. The main ink chamber 231*a* and the detection chamber 231*b* are portioned by a partitioning portion 235. The partitioning portion 235 has in a lower portion thereof a gap 235*a* allowing ink to pass therethrough, and has in an upper portion thereof a communication port 235*b* allowing the main ink chamber 231*a* and the detection chamber 231*b* to communicate with each other. Thus, the levels of the ink surfaces in the main ink chamber 231*a* and the detection chamber 231*b* are maintained to be the same as each other.

Figure 8A:
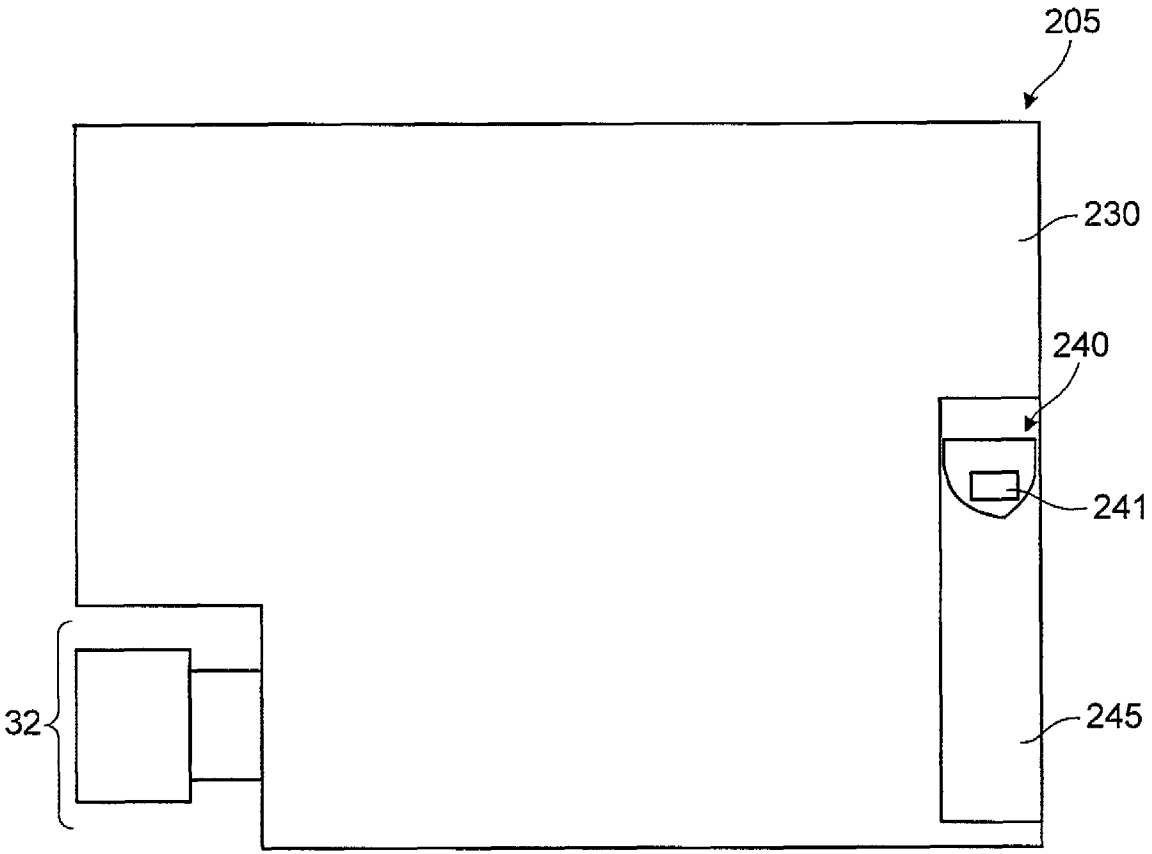
FIG. 8A is a side view of the ink cartridge of FIG. 7.
Figure 9:
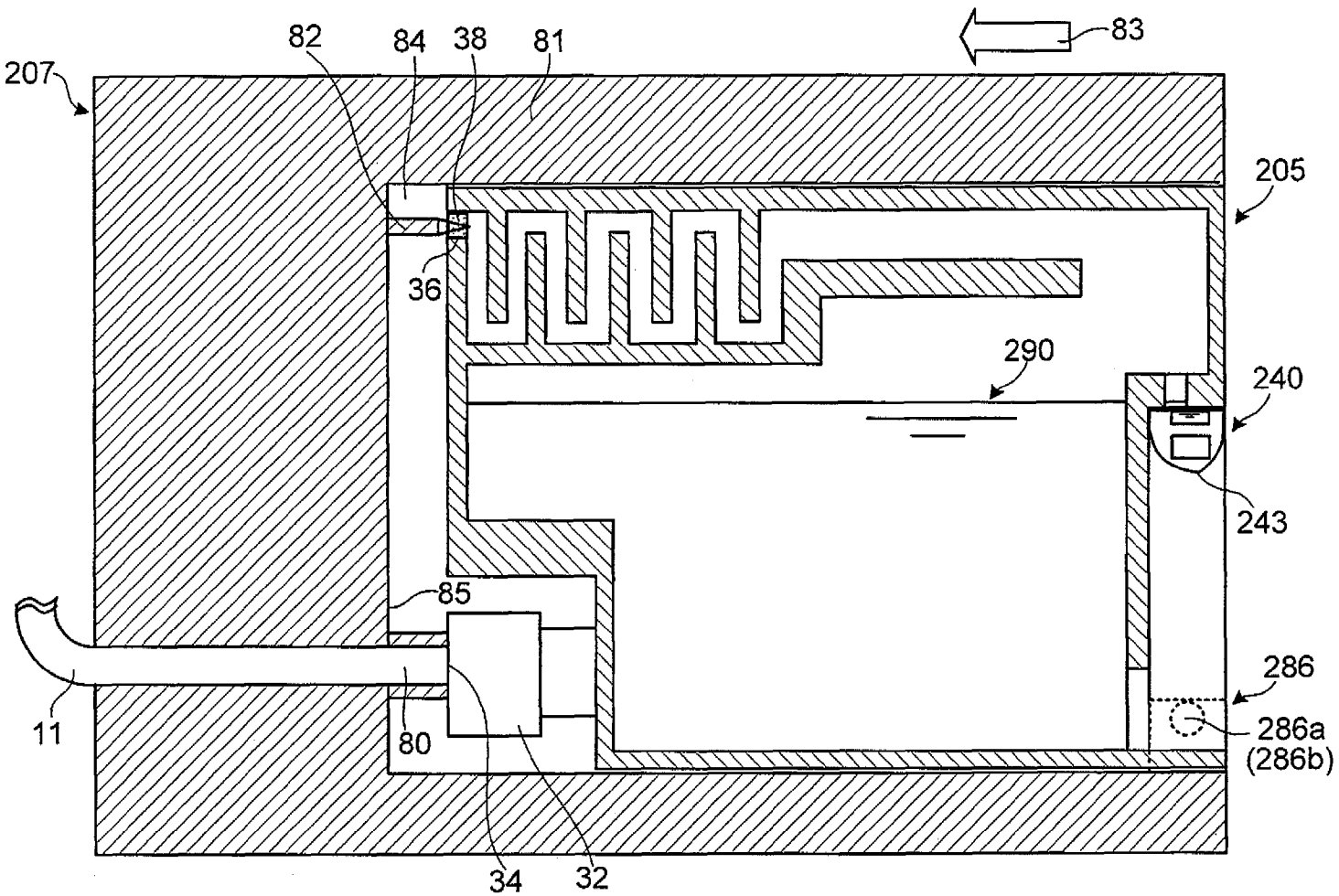
FIG. 9 is a cross-sectional view of the ink cartridge of FIG. 7 and a cartridge mounting portion according to a second embodiment, in which the ink cartridge is mounted to the cartridge mounting portion.

The float 240 is configured to move according to the change in the level of the ink surface in the detection chamber 231*b*. Referring to FIGS. 7 and 8A, the float 240 comprises on a side face thereof a rectangular light-blocking plate 241 configured to block light. The float 240 also comprises in an upper portion thereof an ink-retaining portion 242 (liquid-retaining portion) configured to retain ink therein.

Referring to FIG. 7, the float 240 has, in cross-sectional view, an egg-shaped bottom portion that is convex with a lower-most point 243 being as the apex. That is, the bottom portion of the float 240 is shaped such that the width thereof becomes smaller toward the lower-most point 243, i.e., the apex, gradually. The width of the bottom portion of the float 240 is a dimension in a direction perpendicular to a direction in which the float 240 moves when the ink surface descends. The bottom portion of the float 240 may alternatively be shaped such that the width thereof becomes smaller toward the lower-most point 243, i.e., the apex, linearly. The float 240 is made of a foamed material whose specific gravity is less than the specific gravity of the ink stored in the detection chamber 231*b*. The float 240 may be made of any material, as long as the float 240 can float up toward an ink surface 290. For example, the float 240 may have a closed inner space formed therein When the ink cartridge 205 is mounted to the cartridge mounting portion 207, which will be described below, the light-blocking plate 241 can block light from an optical sensor 286 (see FIG. 9) provided on the cartridge mounting portion 207.

Referring to FIG. 7, the ink-retaining portion 242 is a hollow formed in an upper portion of the float 240, and the hollow has an open end which is open to the exterior of the float 240 at the top of the float 240. At least a portion of the ink-retaining portion 242 is positioned above the ink surface 290 when a portion of the float 240 is positioned above the ink surface. More specifically, the ink-retaining portion 242 has a rectangular shape that is open to the exterior of the float 240 at the top of the float 240 in cross-sectional view taken in the vertical direction.

Next, referring to FIG. 9, the cartridge mounting portion 207 to which the ink cartridge 205 according to the second embodiment is to be mounted will be described.

Referring to FIG. 9, the cartridge mounting portion 207 comprises the frame 81. The frame 81 comprises the pressing portion 82 projecting from an upper portion of the wall surface 85. The ink supply tube 80 is provided at a lower portion of the wall surface 85, and the ink supply tube 80 is configured to be connected to the ink supply portion 32. These elements are identical with those in the first embodiment.

The optical sensor 286 is provided on a lower portion of the frame 81 adjacent to the open end of the frame 81. The optical sensor 286 comprises a light emitter 286*a* and a light receiver 286*b* facing each other with a space interposed therebetween in the horizontal direction such that a lower portion of the detection chamber 231*b* of the ink cartridge 205 is placed therebetween. The light emitter 286*a* emits light such as visible light or infrared light, for example, toward the light receiver 286*b*. Similarly to the first embodiment, whether or not the cartridge 205 is mounted to the cartridge mounting portion 207 is detected by a sensor, e.g., a contact sensor (not shown).

Next, referring to FIGS. 10A-10C, how the remaining amount of ink in the ink cartridge 205 is determined will be described.

Figure 10C:
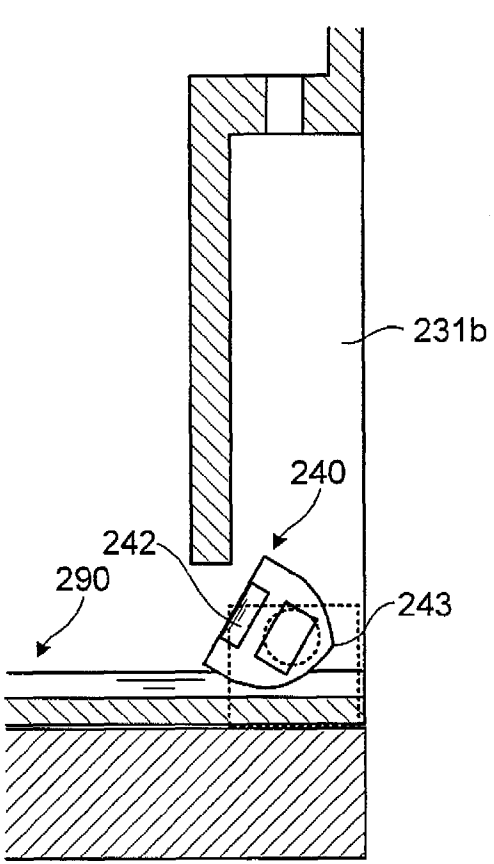
FIGS. 10A-10C are partially broken cross-sectional views of the ink cartridge of FIG. 7, in which a level of an ink surface in FIG. 10A is higher than in FIGS. 10B and 10C, the level of the ink surface in FIG. 10B is lower than in FIG. 10A and higher than in FIG. 10C, and the level of the ink surface in FIG. 10C is lower than in FIGS. 10A and 10B.
Figure 10B:
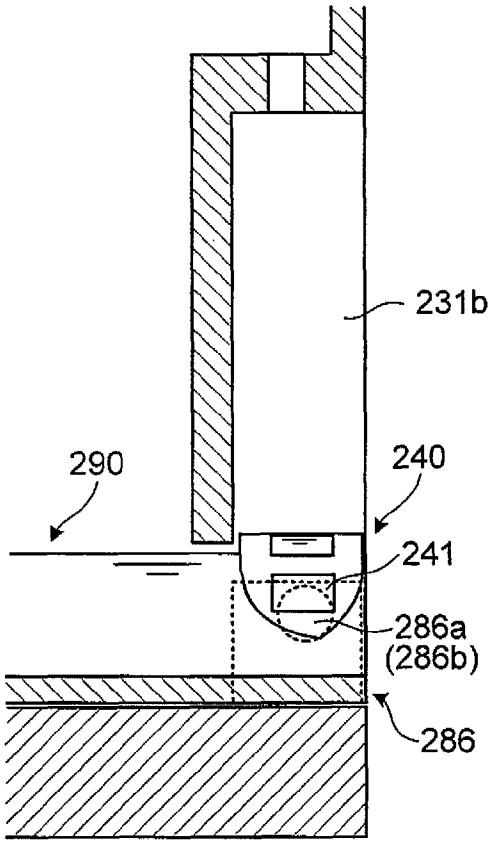
Figure 10A:
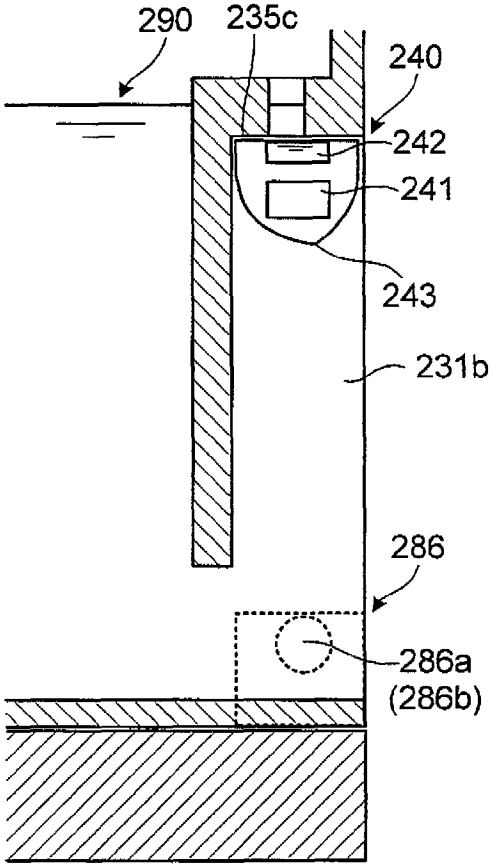

Referring to FIG. 10A, when a sufficient amount of ink is stored in the ink chamber 231, the float 240 is in contact with a ceiling 235*c* of the detection chamber 231*b*. In this state, the entirety of the float 240 is positioned below the ink surface 290. Therefore, the ink-retaining portion 242 of the float 240 is filled with ink.

When the ink cartridge 205 is mounted to the cartridge mounting portion 207, the light receiver 286*b* of the optical sensor 286 faces a lower portion of the detection chamber 231*b*. Because the float 240 is in contact with the ceiling 235*c* of the detection chamber 231*b* when a sufficient amount of ink is stored in the ink chamber 231, the light-blocking plate 241 does not block the light emitted from the light emitter 286*a*. Accordingly, the light emitted from the light emitter 286*a* passes through the detection chamber 231*b* and reaches the light receiver 286*b* at an intensity greater than or equal to a predetermined intensity. In such a situation, the light receiver 286*b* outputs a HIGH signal to the controller 8, as remaining-amount-determiner 62, similarly to the case of the light receiver 186*b*. The controller 8, as the remaining-amount-determiner 62, determines that the remaining amount of ink in the ink cartridge 205 is sufficient and notifies the PC 60 that the remaining amount of ink is sufficient.

Subsequently, when the ink-ejecting operation is performed by the inkjet head 3 and the ink is consumed with the ink-retaining portion 242 of the float 240 being filled with ink, the ink surface 290 in the detection chamber 231*b* of the ink cartridge 205 gradually descends. When a portion of the float 240 is exposed above the ink surface 290, the buoyancy acting on the float 240 is reduced, whereby the buoyancy and gravity acting on the float 240 balance each other out. In this state, at least a portion of the ink-retaining portion 242 is positioned above the ink surface 290 and some ink is retained in the ink-retaining portion 242. Therefore, a gravity equivalent to the mass or weight of the ink retained in the ink-retaining portion 242 also acts on the float 240. When the ink surface 290 further descends, the float 240 in the detection chamber 231*b* moves down following the level of the ink surface 290.

Referring to FIG. 10B, when the level of the ink surface 290 in the ink chamber 231 further descends and reaches a certain level, the light-blocking plate 241 provided on the float 240 reaches a position between the light emitter 286*a* and the light receiver 286*b* of the optical sensor 286. When the light-blocking plate 241 is placed between the light emitter 286*a* and the light receiver 286*b*, the light from the light emitter 286*a* is blocked by the light-blocking plate 241, and the intensity of light reaching the light receiver 286*b* becomes less than the predetermined intensity (including the case where the intensity is zero). In this state, the light receiver 286*b* outputs a LOW signal to the controller 8, as the remaining-amount-determiner 62, similarly to the case of the light receiver 186*b*. Thus, the controller 8, as the remaining-amount-determiner 62, determines that the remaining amount of ink in the ink cartridge 205 has become small and notifies the PC 60 that the remaining amount of ink is small.

Referring to FIG. 10C, when the amount of ink stored in the ink chamber 231 becomes smaller and the lower-most point 243 of the float 240 comes into contact with the bottom surface of the detection chamber 231*b*, the float 240 rotates in the mounting direction 83 about the lower-most point 243, and the ink retained in the ink-retaining portion 242 flows out into the ink chamber 231. Thus, the ink which has been retained in the ink-retaining portion 242 can be used for image recording by the inkjet head 3.

Because the float 240 itself can be visually observed from the outside of the ink cartridge 205 through the transparent cover 245, the user can roughly know the remaining amount of ink.

In the ink cartridge 205 described above, bubbles or films of ink may be generated in the ink chamber 231. For example, if bubbles or films of ink are generated in the detection chamber 231*b*, the movement of the float 240 may be hindered.

With the configuration described above, however, the float 240 comprises the ink-retaining portion 242 configured to retain ink therein, and at least a portion of the ink-retaining portion 242 is positioned above the ink surface 290 when the float 240 is exposed above the ink surface 290. Therefore, when the float 240 is exposed above the ink surface 290, some ink is retained in the ink-retaining portion 242 of the float 240. In the state where the float 240 is submerged in the ink as shown in FIG. 10A, because the mass or weight of the float 240 itself is not increased, the float 240 can break bubbles or films of ink and float up with the force acting on the float 240 to move up the float 240 toward the ink surface 290 not being reduced. In contrast, if the float 240 is exposed above the ink surface 290 as shown in FIG. 10B, a gravity equivalent to the mass or weight of the ink retained in the ink-retaining portion 242 is added to the float 240, whereby a downward force that breaks bubbles or films of ink can be produced. That is, regardless of whether the float 240 moves up or down according to the change in level of the ink surface, the float 240 can move smoothly. Accordingly, the determination of the remaining amount of ink is made correctly.

Moreover, the lower-most point 243 of the float 240 has, in cross-sectional view, an egg-like shape that is convex with the lower-most point 243 being as the apex. Therefore, when the amount of ink stored in the ink chamber 231 becomes small and the lower-most point 243 of the float 240 comes into contact with the bottom surface of the detection chamber 231*b*, the float 240 rotates in the mounting direction 83 about the lower-most point 243, and the ink retained in the ink-retaining portion 242 flows out into the ink chamber 231. Thus, the ink retained in the ink-retaining portion 242 can be used effectively.

Moreover, because the ink-retaining portion 242 has a rectangular shape in the cross-sectional view, the ink-retaining portion 242 can be formed with a relatively simple structure in the float 240.

In another embodiment, a separate sensor similar to the optical sensor 286 may be positioned at the same level as the float 240 when the float 240 is in the position shown in FIG. 10A. In that case, if light from the separate sensor is blocked by the light-blocking plate 241, it can be determined that a substantially full amount of ink remains in the ink cartridge 205. Because the float 240 can break bubbles or films of ink and float up with the force acting on the float 240 to move up the float 240 toward the ink surface 290 not being reduced, the determination that a substantially full amount of ink remains is made correctly.

Next, modified embodiments in which various changes are made to the above embodiments will be described. Herein, elements having configurations identical with those in the first and second embodiments are denoted by the same reference numerals, and the description thereof is omitted appropriately.

In the first embodiment, the ink-retaining portion 142 provided in the float 144 of the pivotable member 140 has a rectangular cross-sectional shape as shown in FIG. 2. The ink-retaining portion 142 is not limited to have such a shape and may have any shape, as long as the ink-retaining portion 142 can retain some ink when the float 144 is exposed above the ink surface. For example, as in the pivotable member 140 according to a modified embodiment No. 1 shown in FIG. 11A and the pivotable member 140 according to a modified embodiment No. 2 shown in FIG. 11B, the ink-retaining portion 142 is a hollow having an open end 301 which is open to the exterior of the float 144 at the top of the float 144, and the open end 301 is narrowed compared to the other portion of the hollow. That is, the sectional area of the open end 301 is smaller than that of the other portion of the hollow With such a configuration, the narrowed open end 301 of the ink-retaining portion 142 can prevent the ink retained in the ink-retaining portion 142 from easily flowing out into the ink chamber 131. Thus, a gravity equivalent to the mass or weight of the retained ink can be assuredly made to act on the float 144.

Figure 11A:
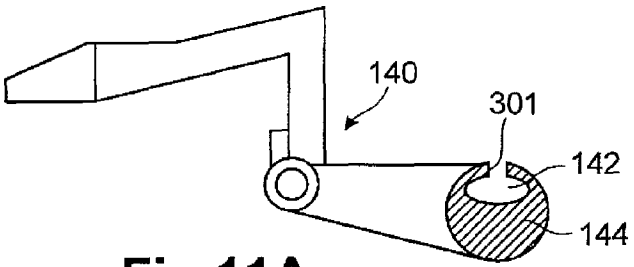
FIGS. 11A-11F are cross-sectional views of pivotable members according to modified embodiments Nos. 1-6, respectively.
Figure 11B:
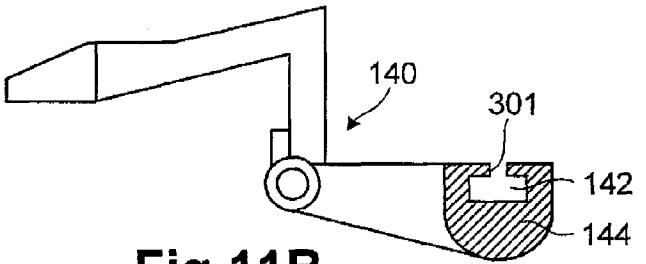
Figure 11C:
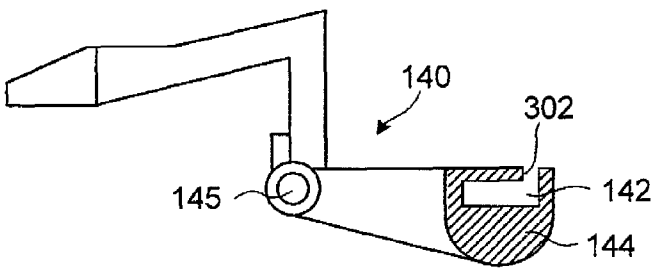
Figure 11D:
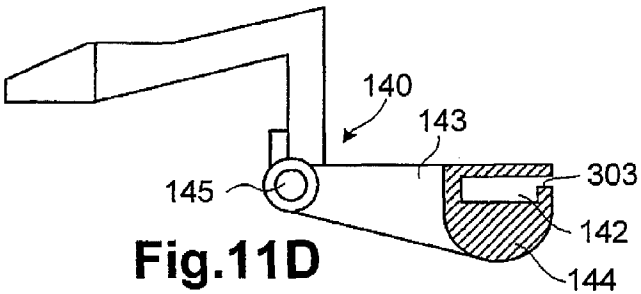

Referring to FIG. 11C, the float 144 comprises a first end (the left end in FIG. 11C) and a second end (the right end in FIG. 11C). The first end of the float 144 is positioned closer to the shaft 145 than the second end of the float 144 is. The ink-retaining portion 142 is a hollow having an open end 302 that is open to the exterior of the float 144 at the top of the float 144. The open end 302 is positioned closer to the second end of the float 144 than to the first end of the float 144 (Modified embodiment No. 3). Alternatively, referring to FIG. 11D, the ink-retaining portion 142 is a hollow having an open end 303 which is open to the exterior of the float 144 in a substantially horizontal direction and is positioned closer to the second end of the float 144 than to the first end of the float 144 (Modified embodiment No. 4).

With such a configuration, the open end 302 or 303 positioned closer to the second end of the float 144 remote from the shaft 145 facilitates the flowing of the ink retained in the ink-retaining portion 142 into the ink chamber 131 through the open end 302 or 303 when the amount of ink stored in the ink chamber 131 becomes small and the float 144 is tilted about the shaft 145 of the arm 143. Thus, the ink retained in the ink-retaining portion 142 can be used effectively.

Figure 11E:
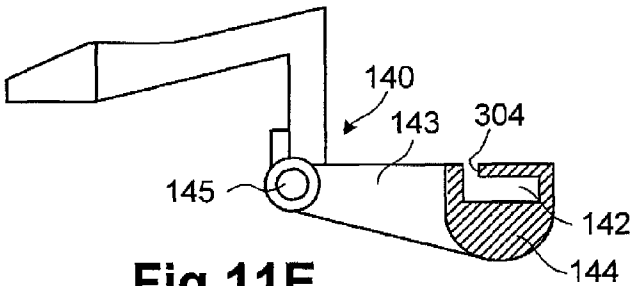

Alternatively, referring to FIG. 11E, the ink-retaining portion 142 is a hollow having an open end 304 positioned closer to the first end of the float 144 than to the second end of the float 144 (Modified embodiment No. 5).

With such a configuration, the open end 304 positioned closer to the first end of the float 144 nearer the shaft 145 can prevent the ink retained in the ink-retaining portion 142 from easily flowing through the open end 304 into the ink chamber 131 even if the amount of ink stored in the ink chamber 131 becomes small and the float 144 is tilted about the shaft 145 of the arm 143. Thus, a gravity equivalent to the mass or weight of the ink can be assuredly made to act on the float 144.

Figure 11F:
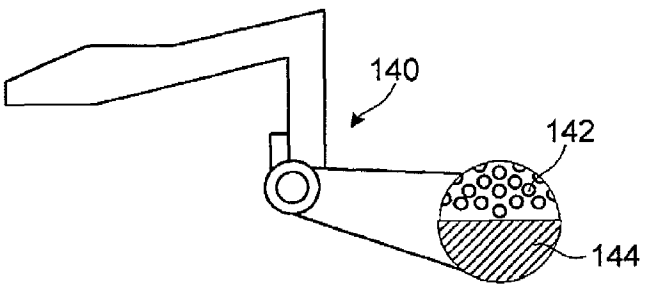

Alternatively, referring to FIG. 11F, the ink-retaining portion 142 provided in the float 144 may be a porous body configured to retain ink therein (Modified embodiment No. 6). The porous body can be made of, for example, polyurethane foam, polyethylene foam, or the like.

With such a configuration, the ink-retaining portion 142, which is a porous body configured to retain ink therein, can prevent ink retained in the porous body from easily flowing out into the ink chamber 131. Thus, a gravity equivalent to the mass or weight of the ink can be assuredly made to act on the float 144.

Figure 12B:
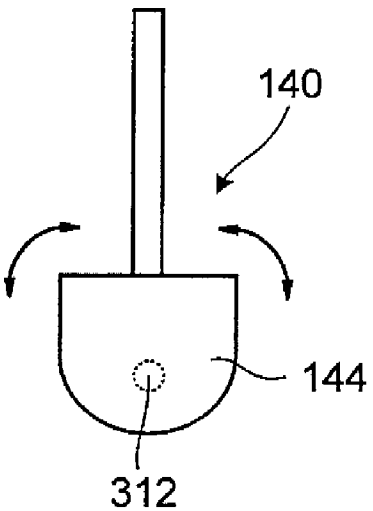
FIG. 12A is a cross-sectional view of a pivotable member according to a modified embodiment No. 7, and FIG. 12(*b*) is a rear view of the pivotable member.
Figure 12A:
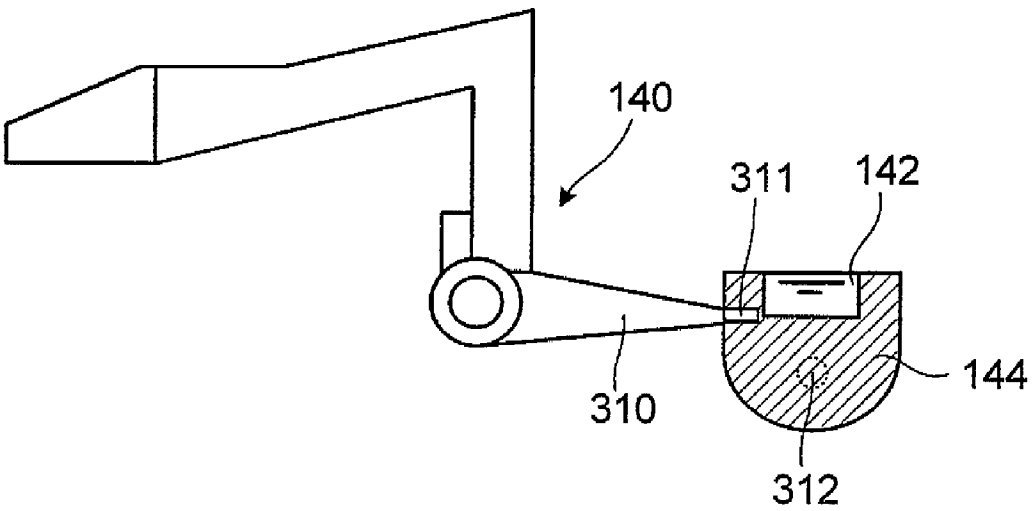

Alternatively, referring to FIGS. 12A and 12B, the float 144 of the pivotable member 140 is attached to a first end 311 of an arm 310, such that the float 144 is rotatable about the first end 311 of the arm 310, and a center of gravity 312 of the float 144 when the ink-retaining portion 142 retains ink is positioned below the first end 311 (Modified embodiment No. 7). The plane in which the float 144 rotates about the first end 311 of the arm 310 is perpendicular to the plane in which the arm 310 pivots about the shaft 145.

With such a configuration, because the float 144 is rotatable about the first end 311 of the arm 310, and the center of gravity 312 of the float 144 is positioned below the first end 311 of the arm 310, the position the float 144 can be stabilized as to be in the horizontal direction, such that the tilting of the float 144 relative to the horizontal plane is prevented even when the ink cartridge 5 is tilted. Thus, the ink retained in the ink-retaining portion 142 can be prevented from easily spilling out. That is, stability against the tilting is provided to the float 144.

While the above embodiments each concern a case where the light-blocking plate 141 or 241 configured to block light is employed as the to-be-detected portion, the to-be-detected portion may have such a configuration that the to-be-detected portion is detected visually or detected by a magnetic sensor or the like.

While the embodiments described above are each an example in which the present invention is applied to an ink cartridge to be used in a printer, the object of application of the present invention is not limited to an ink cartridge. That is, the present invention can be applied to anything regardless of the use and the type of liquid and regardless of whether a container is removably mounted to a liquid-consuming apparatus or is unremovably fixed to a liquid-consuming apparatus.

While the invention has been described in connection with various example structures and illustrative embodiments, it will be understood by those skilled in the art that other variations and modifications of the structures and embodiments described above may be made without departing from the scope of the invention. Other structures and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid container comprising:

a liquid chamber configured to store a liquid; and a float positioned in the liquid chamber and configured to move in a particular direction according to a change in a level of a liquid surface in the liquid chamber, wherein the float comprises a liquid-retaining portion configured to retain the liquid therein, and at least a portion of the liquid-retaining portion is positioned above the liquid surface when a portion of the float is positioned above the liquid surface, wherein the liquid-retaining portion comprises a hollow formed in the float, and the hollow has an open end which is open to an exterior of the float in a direction parallel to the particular direction in which the float moves.

2. The liquid container of claim 1, wherein a bottom portion of the float has a convex shape.

3. The liquid container of claim 2, wherein a width of the bottom portion of the float becomes smaller toward a lowermost point of the bottom portion of the float.

4. The liquid container of claim 1, further comprising an arm configured to pivot about a shaft, wherein the float is positioned at a first end of the arm, and a to-be-detected portion is positioned at a second end of the arm, wherein the to-be-detected portion is configured to move according to a movement of the float.

5. The liquid container of claim 4, wherein the float comprises a first end and a second end, and the first end is positioned closer to the shaft than the second end, wherein the open end of the hollow is positioned closer to the second end of the float than to the first end of the float.

6. The liquid container of claim 4, wherein the float comprises a first end and a second end, and the first end is positioned closer to the shaft than the second end, wherein the open end of the hollow is positioned closer to the first end of the float than to the second end of the float.

7. The liquid container of claim 4, wherein the float is attached to the first end of the arm, such that the float is rotatable about the first end of the arm, and a center of gravity of the float when the liquid is retained in the liquid-retaining portion is positioned below the first end of the arm.

8. The liquid container of claim 1, wherein the open end of the hollow is open to an exterior of the float at an upper portion of the float.

9. The liquid container of claim 8, wherein the open end of the hollow is narrowed compared to another portion of the hollow.

10. The liquid container of claim 1, wherein the liquid-retaining portion comprises a porous body configured to retain liquid therein.

11. The liquid container of claim 1, wherein the liquid container is configured to removably mounted to a container mounting portion of a liquid supply device.

12. A liquid container comprising:

a liquid chamber configured to store a liquid; and a float positioned in the liquid chamber and configured to move according to a change in a level of a liquid surface in the liquid chamber, wherein the float comprises a liquid-retaining portion configured to retain the liquid therein, and at least a portion of the liquid-retaining portion is positioned above the liquid surface when a portion of the float is positioned above the liquid surface, wherein a bottom portion of the float has a convex shape, and wherein a width of the bottom portion of the float becomes smaller toward a lower-most point of the bottom portion of the float.

13. A liquid container comprising:

a liquid chamber configured to store a liquid;

a float positioned in the liquid chamber and configured to move according to a change in a level of a liquid surface in the liquid chamber, wherein the float comprises a liquid-retaining portion configured to retain the liquid therein, and at least a portion of the liquid-retaining portion is positioned above the liquid surface when a portion of the float is positioned above the liquid surface, and an arm configured to pivot about a shaft, wherein the float is positioned at a first end of the arm, and a to-be-detected portion is positioned at a second end of the arm, wherein the to-be-detected portion is configured to move according to a movement of the float, wherein the float is attached to the first end of the arm, such that the float is rotatable about the first end of the arm, and a center of gravity of the float when the liquid is retained in the liquid-retaining portion is positioned below the first end of the arm.

14. A liquid container comprising:

a liquid chamber configured to store a liquid; and a float positioned in the liquid chamber and configured to move according to a change in a level of a liquid surface in the liquid chamber, wherein the float comprises a liquid-retaining portion configured to retain the liquid therein, and at least a portion of the liquid-retaining portion is positioned above the liquid surface when a portion of the float is positioned above the liquid surface, wherein the liquid-retaining portion comprises a hollow formed in the float, and the hollow has an open end which is open to an exterior of the float at an upper portion of the float, and wherein the open end of the hollow is narrowed compared to another portion of the hollow.

15. A liquid container comprising:

a liquid chamber configured to store a liquid; and a float positioned in the liquid chamber and configured to move according to a change in a level of a liquid surface in the liquid chamber, wherein the float comprises a liquid-retaining portion configured to retain the liquid therein, and at least a portion of the liquid-retaining portion is positioned above the liquid surface when a portion of the float is positioned above the liquid surface, wherein the liquid-retaining portion comprises a porous body configured to retain liquid therein.

* * * * *